US006910231B2

(12) United States Patent
Breiing et al.

(10) Patent No.: US 6,910,231 B2
(45) Date of Patent: Jun. 28, 2005

(54) TOILET SYSTEM WITH A TOILET PAN

(75) Inventors: Alois Breiing, Herrliberg (CH); Uwe Werner, Aesch (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 10/470,190

(22) PCT Filed: Jan. 22, 2002

(86) PCT No.: PCT/CH02/00031

§ 371 (c)(1),
(2), (4) Date: Jul. 24, 2003

(87) PCT Pub. No.: WO02/059432

PCT Pub. Date: Aug. 1, 2002

(65) Prior Publication Data

US 2004/0064881 A1 Apr. 8, 2004

(30) Foreign Application Priority Data

Jan. 26, 2001 (CH) ..... 0143/01

(51) Int. Cl.[7] ..... E03D 9/10
(52) U.S. Cl. ..... 4/319; 4/323; 4/431
(58) Field of Search ..... 4/319, 320, 321, 4/323, 378, 379, 380, 431, 434, 407

(56) References Cited

U.S. PATENT DOCUMENTS 1,650,370 A 11/1927 Mahoney
2,865,028 A 12/1958 Patenaude
4,783,859 A * 11/1988 Rozenblatt et al. ..... 4/316

FOREIGN PATENT DOCUMENTS

| | | | |
|---|---|---|---|
| EP | 0704372 | A1 | 4/1996 |
| EP | 0763633 | A1 | 3/1997 |
| EP | 0806527 | A2 | 11/1997 |
| EP | 0887478 | A2 | 12/1998 |
| EP | 1022399 | A1 | 7/2000 |
| WO | WO 9218713 | A | 10/1992 |

* cited by examiner

*Primary Examiner*—Justine R. Yu
*Assistant Examiner*—Peter deVore
(74) *Attorney, Agent, or Firm*—Sughrue Mion, PLLC

(57) ABSTRACT

A toilet system which can be rinsed by a rinsing device. A pipe is connected to the toilet pan and leads to a sanitation pipe. Means are provided for transporting a suction material from the toilet pan into the pipe and into the sanitation pipe. Said means comprise two valves which are arranged in the pipe and a pressure chamber is disposed in-between. In order to suction the suction material from the toilet pan, low pressure is produced in the pressure chamber and used to transport said suctioned material. The pressure chamber is embodied as a piston cylinder and the piston is connected to a controllable drive in order to produce the high and low pressure. The inventive toilet system enables rinsing to occur using a very small amount of water and which can be adapted to different toilet pans.

24 Claims, 2 Drawing Sheets

TOILET SYSTEM WITH A TOILET PAN

BACKGROUND OF THE INVENTION

1. Field of the Invention

The invention relates to a toilet system with a toilet pan, which can be flushed by a flushing arrangement, having a conduit which is connected to the toilet pan and leads to a waste-disposal conduit, having means for transporting a suction-extraction substance from the toilet pan into the conduit and into the waste-disposal conduit, the means having, in the conduit, two valves and, between the latter, a pressure chamber in which it is possible to produce a negative pressure, for the suction extraction of the substance from the toilet pan, and a positive pressure, for transporting the substance, once extracted by suction, into the waste-disposal conduit.

2. Description of the Related Art

Up until now, toilet systems in which the suction-extraction substance is extracted by means of a vacuum have been known, in particular, in vehicles, for example in railroad cars and RVs. For example, WO 92/18713 discloses a toilet system in which an arrangement for producing negative pressure has an intermediate tank and a collecting tank. The abovementioned arrangement evacuates the intermediate tank in order to produce negative pressure, with the result that, with a valve in a conduit being open, the substance is taken into the intermediate tank. Collecting tanks require a large amount of space and have to be emptied. They are not desirable for domestic use.

EP 0 887 478 discloses a toilet system in which a tank is likewise provided. A diaphragm pump is used to produce a partial vacuum in the tank, this resulting in a suction-extraction action.

EP 0 806 527 discloses a flushing arrangement which has a hollow, cup-like closure element. The closure element interacts with an inlet opening and an outlet opening, which are both open or closed in each case.

Toilet systems with a collecting tank in each case have additionally been disclosed by EP 0 704 372 and EP 1 022 399.

EP 0 763 633 A1 discloses a vacuum toilet which, in the discharge conduit, has a pressure chamber between two valves. By virtue of the negative pressure in this chamber, when a valve on the inlet side is opened, suction-extraction substance is sucked from the toilet pan, through the discharge conduit into this chamber. Once the two valves have been switched over, pressure forces the substance from the chamber into a further conduit. An ejector pump which is operated with compressed air is provided in order to evacuate the chamber. A folding bellows in the pressure chamber forms a flexible membrane and serves as a sealing means, and is intended to prevent foul air from passing outward out of the discharge conduit. The production of the negative pressure causes a spring to be stressed, the spring building up a pressure when relieved of stressing. The problem with this toilet system is that sealing the chamber by means of a flexible membrane involves high outlay and is fault-prone. In order to build up a negative pressure, an ejector pump requires a comparatively long period of time. In addition, the pressure which can be achieved in order to expel the substance from the chamber is very limited. This toilet system is not likely to prove successful in practice.

The object of the invention is to provide a toilet system of the abovementioned type which, with low water consumption, is functionally reliable and durable.

SUMMARY OF THE INVENTION

This object is achieved, in the case of a toilet system of the generic type, in that the pressure chamber is designed as a piston cylinder, and the piston is connected to a controllable drive in order to produce the positive pressure and negative pressure. In the case of the toilet system according to the invention, the negative pressure and positive pressure are produced by movement of the piston. This allows a very quick build-up of a negative pressure, for example within a fraction of a second. A positive pressure may likewise be produced very quickly and, in addition, with a positive pressure of more than 1 bar, for example approximately 2 bar. A further advantage of the toilet system according to the invention is that the displacement, and thus the volume of the substance which can be extracted by suction, can be adjusted precisely. It is also possible for two or more suction-extraction cycles to be carried out one after the other. A satisfactory flushing operation is thus possible with a very small amount of water. The piston of the piston cylinder here may itself serve as sealing means for preventing foul air from escaping outward. There is thus no need for a flexible membrane or the like. According to a development of the invention, the piston is moved by means of an electric motor. In conjunction with a control arrangement, this allows precise control of the suction-extraction and expelling operations. These operations, in addition, can be adjusted and adapted to the respective toilet pan.

DETAILED DESCRIPTION OF THE PREFERRED EMBODIMENTS

Figure 1:
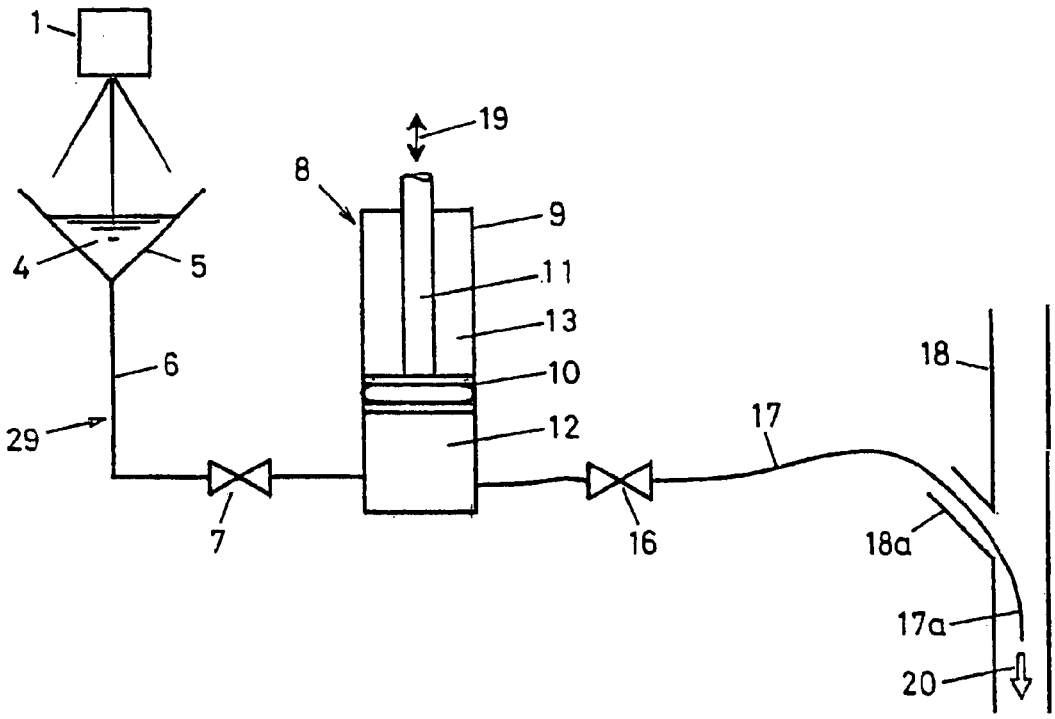
FIG. 1 is a schematic view of a toilet system according to the invention.
Figure 3:
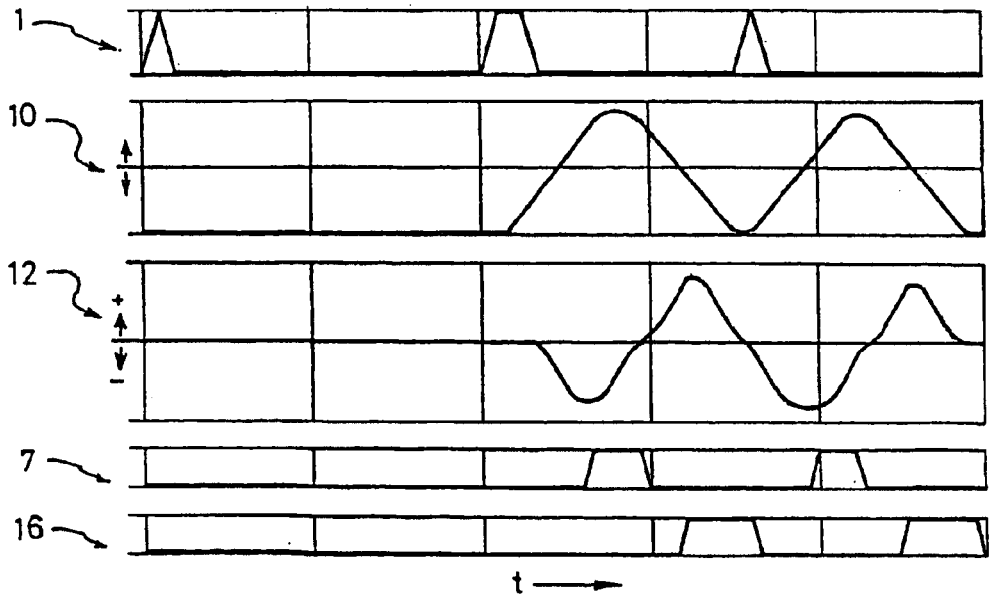
FIG. 3 is a schematic view of the course of a flushing operation over time.
Figure 2:
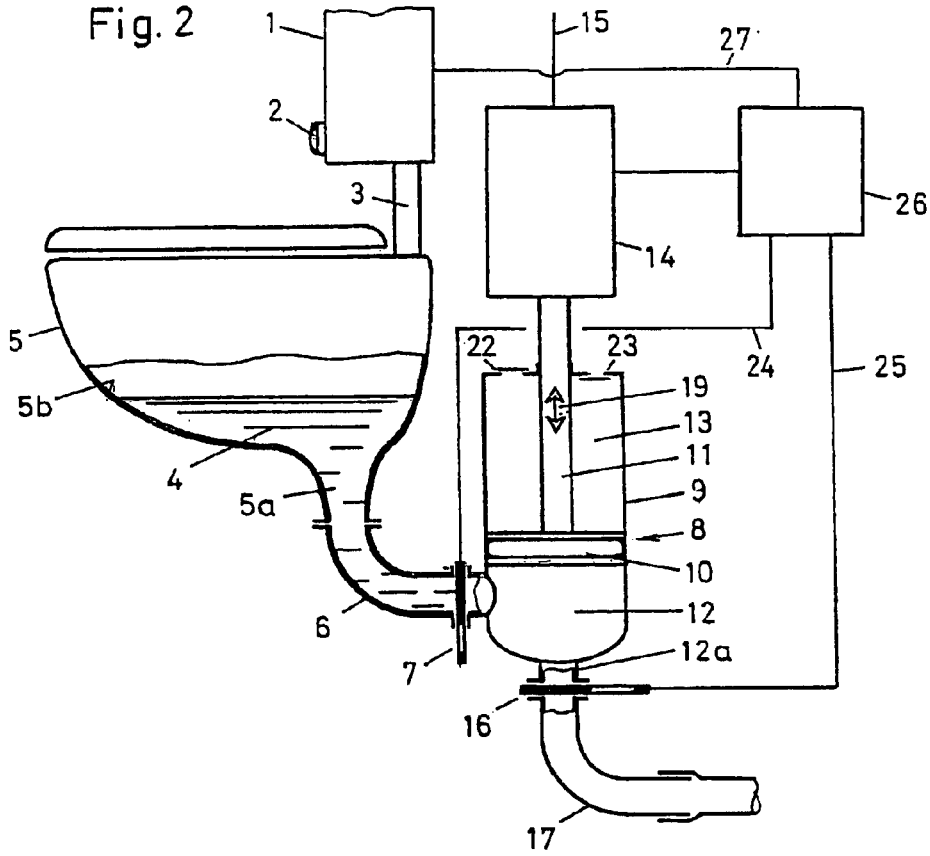
FIG. 2 is a further schematic view of a toilet system according to the invention.

According to FIGS. 1 and 2, the toilet system has a toilet pan 5 which is of hopper-like design and has a bottom outlet 5*a*. This outlet 5*a*, however, is comparatively small and has a cross section of, for example, 30 $mm^2$. Connected to the underside of this outlet 5*a*, in a conduit 29, is a suction line 6, which likewise has a comparatively small cross section. The toilet pan 5 can be flushed by a flushing arrangement 1, and has a flushing pipe 3 through which flushing water can be directed into the interior of the toilet pan 5. The flushing arrangement 1 may be a flushing cistern or some other suitable flushing arrangement. The essential factor, however, is that use is made of a comparatively small amount of flushing water, for example less than 1 liter. The flushing is triggered by a button 2 or by some other suitable triggering arrangement. Contactless or automatic triggering is also conceivable here.

The suction line 6 contains a valve 7 which, in a closed state, closes off the suction line 6 and, in the open state, releases the through-passage to a chamber 12 of a piston cylinder 8. The valve 7 is controlled, via a signal line 24, by a control arrangement 26.

The piston cylinder 8 has a housing 9, in which a piston 10 can be displaced to a limited extent in the directions of the double arrow 19. The piston 10 subdivides the housing 9 into a bottom chamber 12 and into a top chamber 13. The piston 10 seals these two chambers 12 and 13 in relation to one another. For this purpose, an encircling seal 10*a* is arranged on the outside of the piston 10. The piston 10 is moved by a motor 14, for example an electric motor, and is connected to the piston 10 via a piston rod 11 which, as can be seen, has one end projecting out of the housing 9. During movement of the piston 10, by means of valves 22 and 23, air is expelled into the surroundings from the top chamber 13 and/or fresh air is drawn in from the ambient air. The valves 22 and 23 may be straightforward flap valves. Power is supplied to the motor 14 via a power line 15. Power is likewise supplied to the control arrangement 26 via this line. The control arrangement 26 may also be integrated in the motor 14.

The bottom chamber 12 has an outlet 12*a* which, as can be seen, is arranged at the lowermost point of the bottom chamber 12 and to which a pressure line 17 is connected. The pressure line 17 may be a flexible hose or a fixed pipeline. Located in the vicinity of the outlet 12*a* is a further valve 16, which is controlled, via a signal line 25, by the control arrangement 26. In one state, the through-passage to the pressure line 17 is closed and, in the other state, this through-passage is free. The bottom chamber 12 forms a pressure chamber and this may be integrated in the toilet pan 5 and form a unit therewith.

The pressure line 17 has a cross section which may correspond essentially to the cross section of the suction line 6. This cross section is thus likewise comparatively small and may be compared, for example, with that of a garden hose. It may be comparatively long, for example a number of meters in length, and, according to FIG. 1, lead to a downpipe of a waste-disposal conduit 18. The pressure line 17 preferably has a front end 17*a* which projects comparatively deeply, for example a number of meters, into a waste-disposal conduit 18. The pressure line 17 is introduced into the waste-disposal conduit 18, for example, by way of a lateral connector 18*a*.

The operation of the toilet system according to the invention is explained hereinbelow.

The rest state of the toilet system is shown in FIG. 2. The valves 7 and 16 are closed and the piston 10 is located in the bottom position shown. When the toilet system is used, the flushing arrangement 1 may be actuated for preliminary wetting of the inside 5*b* of the toilet pan 5. As a result of use, the suction-extraction substance 4 collects in the toilet pan 5, the substance filling the suction line 6 as far as the valve 7. Flushing is triggered by actuation of the button 2. In this case, water passes through the flushing pipe 3 into the toilet pan 5. The quantity of water used here is controlled via the control means 26 and the signal line 27. One or more nozzles are preferably provided for spraying the inside 5*b* of the toilet pan 5.

Figure 4:
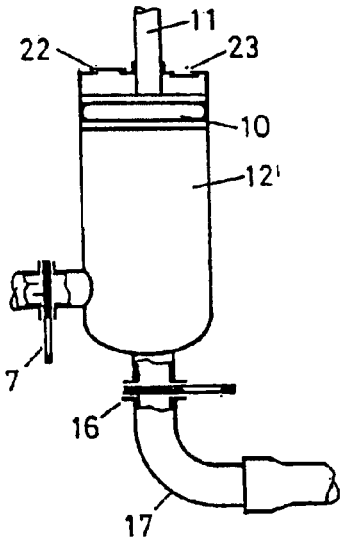
FIGS. 4–6 are schematic views of a suction-extraction substance being taken in and expelled.
Figure 5:
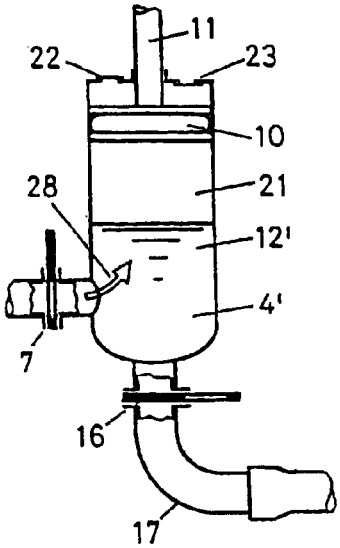
Figure 6:
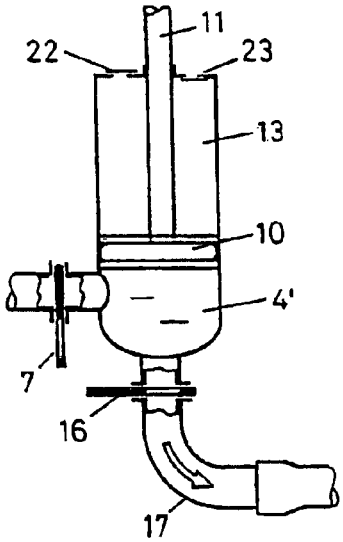

Following spraying, the piston 10 moves approximately into the position shown in FIG. 4. The uppermost position is preferably not quite reached here. Since the valves 7 and 16 are still closed, a negative pressure which is preferably less than, for example, 0.5 bar is thus produced in a chamber 12'. At the same time, further flushing of the toilet pan 5 can be triggered via the control arrangement 26. Approximately simultaneously, the valve 7 is opened comparatively quickly, and thus essentially abruptly. The quick opening may be brought about, for example, by a prestressed spring (not shown here). Approximately simultaneously, flushing of the toilet pan 5 is interrupted. The bottom chamber 12' is large enough to be filled approximately half with air and half with suction-extraction substance 4. When the substance 4 is extracted by suction, the solids are reduced in size by suddenly flowing into the bottom chamber 12', with the result that the substance 4' extracted by suction is present in a state similar to a suspension. In FIG. 5, the arrow 28 shows the direction in which the substance 4 flows into the bottom chamber 12'. Located above the substance 4' is an air cushion 21 which, as has been mentioned above, takes up approximately half the volume of the bottom chamber 12'.

Once the substance 4 has been extracted by suction, then the valve 7 is closed and the piston 10 moves downward, the air cushion 21 being compressed and a positive pressure of, for example, 2 bar being produced. The valve 16 is then opened and, as a result of the positive pressure, the substance 4' is expelled into the pressure line 17 and, finally, into the waste-disposal conduit 18. The valve 16 is then closed. When the piston 10 is moved downward, fresh air from the ambient air is directed into the top chamber 13 via the valve 22. The pressure line 17 is usually filled, at least in part, with suction-extraction substance 4'. In order for this substance to be expelled as well, a second flushing operation is preferably triggered. In this case, the toilet pan 5 is flushed again and this flushing water, by means of the operation explained above, is taken in and then expelled. By virtue of this further operation, the pressure line 17 is flushed through with water and cleaned at least in part. This further flushing water passes into the waste-disposal conduit 18.

The suction line 6 opens out preferably tangentially and preferably also downward into the pressure chamber 12. This results in particularly favorable dynamics for the suction-extraction substance 4 and thus the flow of this substance 4 in and out of the cylinder 8. The substance 4 flows tangentially, and in a downwardly directed manner, into the pressure chamber 12 and thus, as it were, flushes the cylinder 8 and rotates in the pressure chamber 12. The substance 4 is then expelled. Since everything is in motion, it is possible to avoid deposits in the pressure chamber 12. Particles which are nevertheless deposited are flushed up again. Contact with the piston 10 and the seal is largely avoided.

What is claimed is:

1. A toilet system comprising:

a toilet pan, a flushing arrangement for providing flushing liquid, a conduit which is connected to the toilet pan and leads to a waste disposal conduit, means for transporting a waste substance from the toilet pan into the conduit and into the waste-disposal conduit, the means having, in the conduit, a first valve and a second valve and a pressure chamber disposed between said first valve and said second valve, said pressure chamber being operative to produce a negative pressure, for the suction extraction of the waste substance from the toilet pan, and a positive pressure, for transporting the waste substance, once extracted by suction, into the waste-disposal conduit, said pressure chamber having a piston cylinder and a piston;

a drive, said piston being connected to said drive and being movable by said drive within said cylinder in order to produce the positive pressure and negative pressure, and an electronic control means, the drive and the two valves being selectively controlled by said control means whereby, for the suction extraction of the waste substance from the toilet pan, the piston is controlled to move to create the negative pressure in the chamber with the valves closed, and thereafter one of said first and second valves is rapidly opened whereby the waste substance is extracted from the toilet pan into said pressure chamber with a force.

2. The toilet system as claimed in claim 1, wherein the piston is driven electrochemically.

3. The toilet system as claimed in claim 1, wherein connected to an outlet of the pressure chamber is a pressure line, through which the substance is transported into the waste-disposal conduit.

4. The toilet system as claimed in claim 1, wherein a positive pressure greater than about 1 bar is produced in the pressure chamber.

5. The toilet system as claimed in claim 1, wherein the stroke of the piston is adjustable.

6. The toilet system as claimed in claim 1, wherein arranged between the toilet pan and the piston cylinder is a suction line, which opens out tangentially into the pressure chamber.

7. The toilet system as claimed in claim 1, wherein arranged between the toilet pan and the piston cylinder is a suction line, which opens out obliquely downward into the pressure chamber.

8. The toilet system as claimed in claim 1, wherein the pressure chamber forms a unit with a toilet pan.

9. The toilet system as claimed in claim 6, wherein, at its lowermost point, the pressure chamber has an outlet to which a pressure line is connected.

10. The toilet system as claimed in claim 1, wherein a positive pressure greater than 1.5 bar is produced in the pressure chamber.

11. The toilet system as claimed in claim 2, wherein connected to an outlet of the pressure chamber is a pressure line, through which the substance is transported into the waste-disposal conduit.

12. The toilet system as claimed in claim 2, wherein a positive pressure greater than about 1 bar is produced in the pressure chamber.

13. The toilet system as claimed in claim 3, wherein a positive pressure greater than about 1 bar is produced in the pressure chamber.

14. The toilet system as claimed in claim 2, wherein the stroke of the piston is adjustable.

15. The toilet system as claimed in claim 3, wherein the stroke of the piston is adjustable.

16. The toilet system as claimed in claim 4, wherein the stroke of the piston is adjustable.

17. The toilet system as claimed in claim 2, wherein arranged between the toilet pan and the piston cylinder is a suction line, which opens out tangentially into the pressure chamber.

18. The toilet system as claimed in claim 3, wherein arranged between the toilet pan and the piston cylinder is a suction line, which opens out tangentially into the pressure chamber.

19. The toilet system as claimed in claim 4, wherein arranged between the toilet pan and the piston cylinder is a suction line, which opens out tangentially into the pressure chamber.

20. The toilet system as claimed in claim 5, wherein arranged between the toile pan and the piston cylinder is a suction line, which opens out tangentially into the pressure chamber.

21. The toilet system as claimed in claim 1, wherein the drive is an electronic drive.

22. The toilet system as claimed in claim 1, wherein the force is operative to reduce waste solids.

23. The toilet system as claimed in claim 1, wherein said negative pressure is produced with a single stroke of said piston.

24. The toilet system as claimed in claim 1, wherein said positive pressure is produced with a single stroke of said piston.

* * * * *